United States Patent [19]

Kiss et al.

[11] Patent Number: 4,571,194

[45] Date of Patent: Feb. 18, 1986

[54] COLLAPSIBLE AND FLOATABLE BEVERAGE HOLDER

[76] Inventors: James M. Kiss, 909 Rosewood, Carpentersville, Ill. 60110; Mathew R. P. Perrone, Jr., 306 Rustic La., Algonquin, Ill. 60102

[21] Appl. No.: 600,037

[22] Filed: Apr. 13, 1984

[51] Int. Cl.[4] ..... B63B 22/00

[52] U.S. Cl. ..... 441/1

[58] Field of Search ..... 441/1, 81, 86, 129, 441/130, 131, 132, 135, 136; 4/489, 496; 220/1 R

[56] References Cited

U.S. PATENT DOCUMENTS

| | | | |
|---|---|---|---|
| 2,803,839 | 8/1957 | Mosley | 441/131 |
| 3,015,406 | 1/1962 | Nolte | 220/1 R |
| 3,367,525 | 2/1968 | Elder | 220/1 R |
| 3,533,529 | 10/1970 | Helbig | 220/1 R |
| 3,831,209 | 8/1974 | Clingman | 441/1 |
| 4,223,415 | 9/1980 | Patton | 441/86 |
| 4,305,170 | 12/1981 | Atherton | 114/346 |

FOREIGN PATENT DOCUMENTS

| | | | |
|---|---|---|---|
| 757183 | 12/1933 | France | 441/1 |

*Primary Examiner*—Sherman D. Basinger
*Assistant Examiner*—Jesûs D. Sotelo
*Attorney, Agent, or Firm*—Mathew R. P. Perrone, Jr.

[57] ABSTRACT

A flotation device for holding a beverage is formed from an inflatable ring having a sheet secured to the center and a beverage holder secured in the center of the sheet.

3 Claims, 4 Drawing Figures

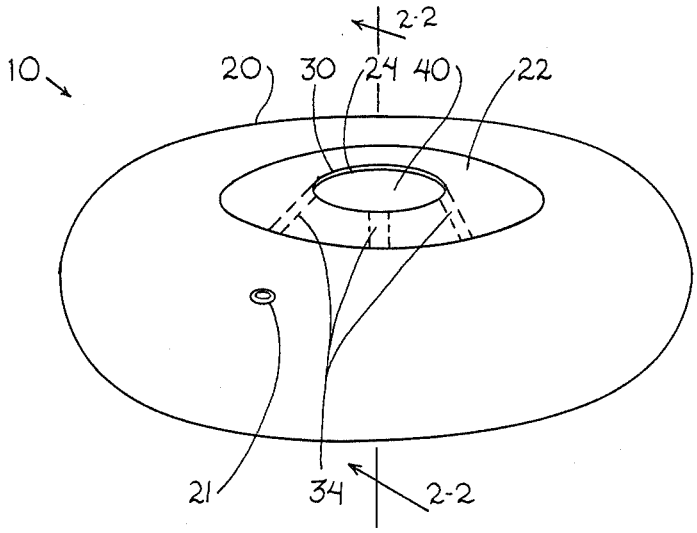
Fig. I
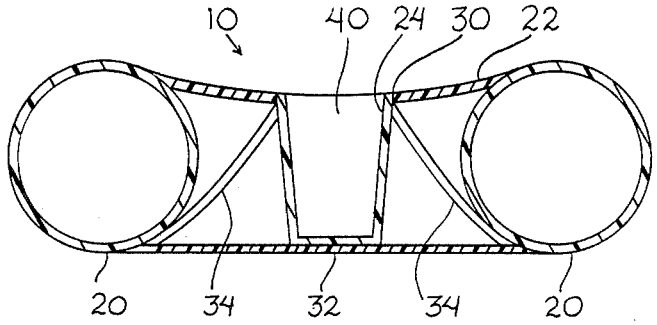
Fig II
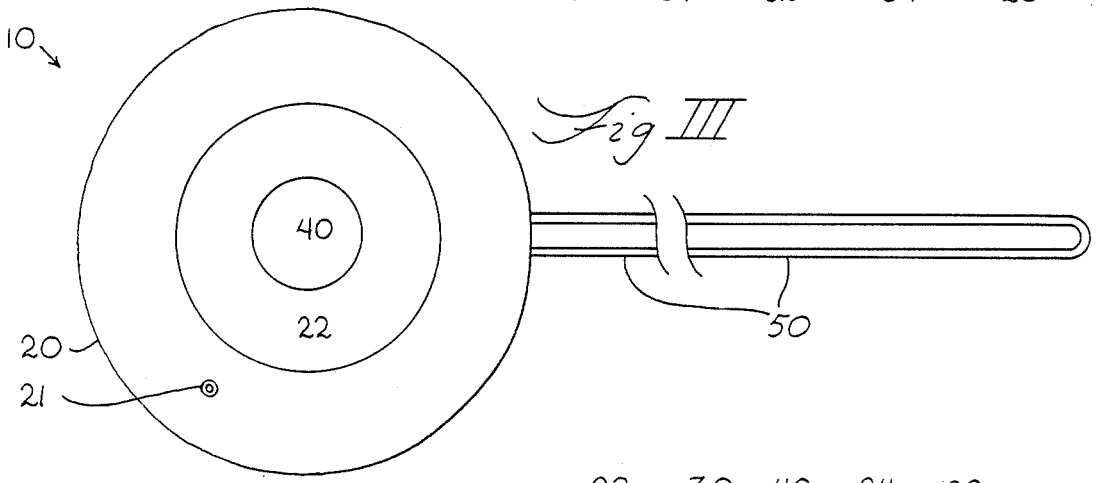
Fig III
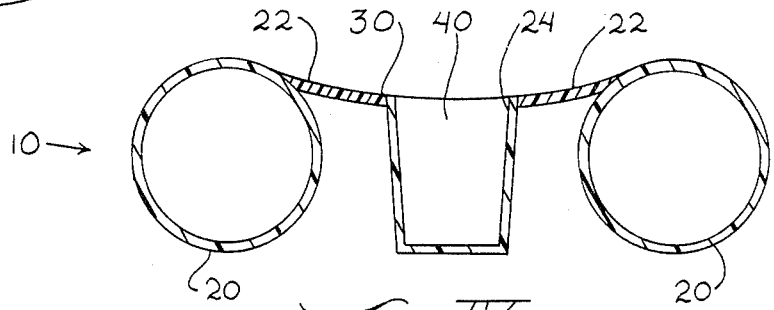
Fig. IV

COLLAPSIBLE AND FLOATABLE BEVERAGE HOLDER

BACKGROUND OF THE INVENTION

This invention relates to a floating device and more particularly to a collapsible and inflatable, flotation device capable of holding a beverage container.

One of the favorite means of relaxation of people throughout the United States is floating in a swimming pool or other body of water suitable for swimming. This flotation is accomplished by using devices such as an air mattress, an inner tube, or similar devices.

Many times, while floating in these devices, a person desires to have a beverage available. One method of making a beverage available to a person floating is solved by a device which is basically a foldable lawn chair supported by styrofoam or similar flotation devices. Within the flotation device, may be a recess suitable for holding a beverage container. This particular device is bulky and difficult to carry and further may only be used in restricted circumstances. The restrictive use of this device is due mainly to its bulkiness and difficulty of transportation.

It is therefore desirable to provide a device which is not bulky but can achieve the desired goal. Needed is a device which is relatively stable, easily transportable, and capable of holding a beverage container and being held at a position adjacent to the person who is floating. These differing features of the invention are in many respects contradictory. If the device is easily transportable, it may lack stability. If the device has stability, it may lack the transportability.

Thus, many problems exist in providing a device suitable for having a beverage container close to a person floating in a body of water.

SUMMARY OF THE INVENTION

Therefore, it is an object of this invention to provide a floatable device capable of supporting a beverage near a person floating in the water.

A further object of this invention is to provide a device which is stable.

A still further object of this invention is to provide a device which is easily transportable.

Yet a further object of this invention is to provide a device which will maintain the beverage in appropriate proximity to the person while the person is floating in a body of water.

Also an object of this invention is to provide a device which is completely collapsible for ease of transportation.

These and other objects of this invention are met by having an inflatable device comprising an inflatable ring having a sheet secured to the inner sides of the ring, with a beverage holding device mounted in the center of the sheet.

BRIEF DESCRIPTION OF THE DRAWING

FIG. I is a perspective view of the beverage flotation device 10.

FIG. II is a cross section of FIG. I along section line 22.

FIG. III is a top view of beverage flotation device 10 including a strap 50 for attaching beverage flotation device 10 to an inner tube.

FIG. IV is a modification of FIG. II.

DESCRIPTION OF THE PREFERRED EMBODIMENTS

A flotation device for holding a beverage is formed from an inflatable ring having a sheet secured to the center and a beverage holder secured in the center of the sheet.

Referring now to FIG. I, beverage holding device 10 includes an inflatable ring 20. Ring 20 is inflated at valve 21 by blowing or mechanical pumping means. Sheet 30 is situated within ring 20 and expands to cover the center of ring 20 when ring 20 is inflated. Ring 20 may be inflated through valve 21. Valve 21 is a standard inflation valve, which may be used alone or in combination with similar valves in order to inflate all inflatable sections of device 10. When ring 20 is deflated, beverage holding device 10 can be folded into a small package and carried easily.

Substantially centrally located within sheet 22 is beverage support 40. Beverage support 40 receives a beverage container (not shown) within the flotation device and provides for a stable holding of the beverage container. Stability is due to the outer ring 20 being large enough to provide a stable setting. The sheet connection 30 to the beverage support 40 adds the stability. The stability is formed by the sheet being thinner than the expanded tube. Such expansion provides for great stability to beverage support 40. This stability permits removing the beverage container from support 40, and replacing the same. As can be seen from the drawing, and especially FIG. II and FIG. IV, beverage holder 40 is the interior space of beverage support 24.

FIG. II which is a cross section of FIG. I depicts a lower support sheet 32 covering the base of beverage support 40. This procedure provides for more stable location for beverage support 40 as do side straps 34 protruding from the lower support (or bottom) sheet 32 and the ring 20 to the edge of beverage support 40. Side straps 34 may also be inflatable.

FIG. III depicts the beverage holding device 10 having an additional strap holder 50. Strap holder 50 can be inserted through the flotation device 10 or otherwise secured to the flotation device 10 while the device 10 is being used by someone. In this fashion, beverage flotation device 10 can remain close to the person using the flotation device for cooling purposes. Thus, the combination of both the beverage and soaking in water provides additional cooling for the person as desired.

FIG. IV is a modification of FIG. II absent the bottom sheet 32. If the desired stability can be achieved without the bottom sheet 32, less bulk may be obtained. Bottom sheet 32 is, however, preferred to be used.

Suitable materials may be used for this feature. It is required that the materials be inflatable and flexible. In this fashion, when ring 20 is deflated, beverage support 10 may be folded into a small, easily-carried package. Thus, it is desired to make this beverage support 10 out of thin, flexible, air-impervious material. In this fashion, the ring 20 can be inflated as desired. The flexible sheet 22 and the beverage holder 24 are forced into position when the ring is inflated. Thus, the desired stability is achieved.

Typical of the material suitable in making this flexible container are synthetic resins and plastics which do not react with water, or even chlorinated or salt water. Typical materials include polyvinylchloride. Other materials, of course, are suitable for use. The main requirement of a material for this invention is that it be capable of forming an inflatable structure which floats. To that end the device of this invention may be made from a single material or a plurality of materials, so long as the inflating and floating perquisites are met. Appropriate designs may be placed on the beverage support 10. For example, such a beverage holding ring can be used as a promotional device for advertising.

Because of this disclosure and solely because of this disclosure various modifications of this beverage flotation device can become clear to a person having ordinary skill in this art. Such modifications are clearly covered hereby.

What is claimed and sought to be secured by Letters Patent of the United States is:

1. A flotation device for holding a beverage adjacent to a person floating in a body of water, said flotation device including an inflatable, tubular ring; a first flexible sheet secured within said ring; a second flexible sheet is secured to said ring and covers a base of said beverage support; and a beverage support centrally secured in said first flexible sheet; said flotation device further comprising:

a. a valve means being secured to said ring for inflating said flotation device;

b. said beverage support being collapsible; and c. at least two side straps running from said ring to said beverage support in order to strengthen said beverage support and said flotation device.

2. The flotation device of claim 1 further including a strap holder to be secured to said flotation device at a first end of said strap holder and secured to a point adjacent a person at a second of said strap holder in order that said flotation device can remain close to said person.

3. The flotation device of claim 2 wherein said side straps extend from said ring to said beverage support.

* * * * *